US006968978B1

(12) United States Patent
Matthews

(10) Patent No.: US 6,968,978 B1
(45) Date of Patent: Nov. 29, 2005

(54) WALL MOUNTABLE DISPENSER FOR COLLAPSIBLE TUBES

(76) Inventor: William B Matthews, 100 S. Brayton Rd., Tiverton, RI (US) 02878

( * ) Notice: Subject to any disclaimer, the term of this patent is extended or adjusted under 35 U.S.C. 154(b) by 0 days.

(21) Appl. No.: 11/029,848

(22) Filed: Jan. 5, 2005

(51) Int. Cl.[7] ..... B65D 35/28
(52) U.S. Cl. ..... 222/103
(58) Field of Search ..... 222/103

(56) References Cited

U.S. PATENT DOCUMENTS

| | | | |
|---|---|---|---|
| 2,085,673 | A | 6/1937 | Roache |
| 2,848,141 | A | 8/1958 | Intagliata |
| 3,384,271 | A | 5/1968 | Gronwald |
| 4,010,873 | A | 3/1977 | Mardirossian |
| 4,125,206 | A | 11/1978 | Wilson |
| 4,850,971 | A | 7/1989 | Colvin |
| 5,035,347 | A | 7/1991 | Trovo |
| 5,810,205 | A | 9/1998 | Kohen |
| 6,401,978 | B1 | 6/2002 | Young |

FOREIGN PATENT DOCUMENTS

| | | |
|---|---|---|
| EP | 078.871 | 5/1983 |
| GB | 2.002.321 | 2/1979 |
| GB | 2.052.434 | 1/1981 |

*Primary Examiner*—Philippe Derakshani
(74) *Attorney, Agent, or Firm*—Michael I. Kroll

(57) ABSTRACT

Apparatus 10 discloses a toothpaste dispenser comprising a housing 14 with a movable lever in communication with a dispensing means engaging a tube 12 of toothpaste within the housing. The housing 14 is comprised of a cover 22 and base 20 with the base having side walls and an end wall with an aperture 28 for inserting the tube spout 23. Mounted within the base 20 is a pliable planar member 24 that covers the collapsible tube 12 when inserted therein. There is also at least one aperture within the base 20 providing means for mounting the dispenser to a structure, such as a wall. The cover 22 has opposing side walls and end wall for receiving the base and a longitudinal slot 18 for the handle 16 of the dispensing means to travel therealong. The dispensing means is comprised of a roller 26 rotatable within a frame or bracket 34 having an exteriorly positioned handle 16 attached thereto. Once a collapsible tube 12 is inserted under the pliable member 24 and the spout cover is removed, the tube contents can be extruded by moving the handle 16 that causes the roller 26 to engage the pliable member 24 thereby compressing the tube. The dispensing means engages the tube 12 at its closed end and compresses the tube flat as it moves towards the nozzle or spout 23 over time.

11 Claims, 9 Drawing Sheets

WALL MOUNTABLE DISPENSER FOR COLLAPSIBLE TUBES

BACKGROUND OF THE INVENTION

1. Field of the Invention

The present invention relates generally to dispensers and, more specifically, to a toothpaste dispenser comprising a housing with a movable lever in communication with a dispensing means engaging a tube of toothpaste within said housing. The housing is comprised of a cover and base with the base having side walls and an end wall with an aperture for inserting the tube spout. Mounted within the base is a pliable planar member that covers the collapsible tube when inserted therein. There is also at least one aperture within the base providing means for mounting said dispenser to a structure, such as a wall. The cover has opposing side walls and end wall for receiving the base and a longitudinal slot for the handle of the dispensing means to travel therealong. The dispensing means is comprised of a roller rotatable within a frame having an exteriorly positioned handle attached thereto. Once a collapsible tube is inserted under the pliable member and the spout cover is removed, the tube contents can be extruded by moving the handle that causes the roller to engage the pliable member and thereby compressing the tube. The dispensing means engages the tube at its closed end and compresses the tube flat as it moves towards the nozzle over time.

The pliable member covering the tube serves a dual purpose in that it displaces the forces applied by the roller over a larger area than would be possible if the roller where to engage the tube directly. In addition, the roller engaging the tube directly could cause the tube to curl as the contents are dispelled with the tube getting caught-up in the roller mechanism.

Furthermore, when the dispenser is wall mounted the pliable member will keep the tube positioned properly against the base permitting the roller to compress the tube rather than crush it, which can be the case with a new tube or when the roller is backed off of the tube allowing it to flop around.

As an additional element of the present invention, a compression spring can be inserted between the handle and roller thereby should the nozzle become clogged the compression spring will prevent rupturing of the tube.

2. Description of the Prior Art

There are other dispensers designed for collapsible tubes. Typical of these is U.S. Pat. No. 2,085,673 issued to Roache on Jun. 29, 1937.

Another patent was issued to Intagliata on Aug. 19, 1958 as U.S. Pat. No. 2,848,141. Yet another U.S. Pat. No. 3,384,271 was issued to Gronwald on May 21, 1968 and still yet another was issued on Mar. 8, 1977 to Mardirossian as U.S. Pat. No. 4,010,873.

Another patent was issued to Wilson on Nov. 14, 1978 as U.S. Pat. No. 4,125,206. Yet another U.S. Pat. No. 4,850,971 was issued to Colvin on Jul. 25, 1989. Another was issued to Trovo on Jul. 30, 1991 as U.S. Pat. No. 5,035,347 and still yet another was issued on Sep. 22, 1998 to Kohen as U.S. Pat. No. 5,810,205.

Another patent was issued to Young on Jun. 11, 2002 as U.S. Pat. No. 6,401,978. Yet another U.K. Patent No. GB2 002 321 was issued to Wright on Feb. 21, 1979. Another was issued to Park on Jan. 28, 1981 as U.K. Patent No. GB2 052 434 and still yet another was published on May 18, 1983 to Knight as European Patent Application No. EP0078871.

U.S. Pat. No. 2,085,673

Inventor: Paul F. Roache

Issued: Jun. 29, 1937

A dispenser comprising a casing, including a hinged section to permit a collapsible container to be arranged in the casing in an inverted position with the discharge neck thereof extending outwardly of the casing, a closure for said container and pivoted to the casing, squeezing means adaptable to the container, a rod pivoted to said closure and extending through said casing, a feed shaft journaled in said casing and extending exteriorly thereof, a sleeve slidably and rotatably mounted on said feed shaft, a finger piece secured to said sleeve and engaged by said rod, spring means acting on said sleeve, spring means acting on said rod, means connecting the squeezing means to the feed shaft, and a clutch between the feed shaft and said sleeve and engaged by endwise movement of the sleeve on the feed shaft.

U.S. Pat. No. 2,848,141

Inventor: Dominic Intagliata

Issued: Aug. 19, 1958

In a device for dispensing the contents of a collapsible tube of the type described, the combination of: a rectangular casing for the reception and support of the tube, said casing including a bottom wall, a front end wall, a rear end wall, and a pair of side walls; a circular opening formed centrally in the front end wall, said opening being of a size adapted to have the nozzle portion of the tube extend therethrough; a horizontal flange extending inwardly from the top margin of each side wall; a reciprocable cylindrical roller adapted to be manually incrementally advanced along the upper surface of the tube from the rear to the front end wall of the casing; a pair of transversely spaced guide members for the roller rigidly secured to the bottom wall of the casing and longitudinally substantially coextensive therewith, said guide members also serving to confine the tube body therebetween; a stud projecting axially from each end of the roller; and a pair of relatively heavy downwardly biased leaf springs each including a rear end portion secured to the underside of the rear end portion of one of said horizontal flanges of the casing side walls aforesaid, and a free forwardly extending body portion bearing against one of said studs as the roller is advanced.

U.S. Pat. No. 3,384,271

Inventor: Walter F. Gronwald

Issued: May 21, 1968

A dispensing device for collapsible containers which comprises a rectangular base plate having a forward container-receiving surface, a container-engageable member having a sliding path of movement along said surface, an open-ended channel extending along each longitudinal edge of said plate and integral therewith, said plate and channels being of uniform cross-section throughout the lengths thereof, each said channel having a wall overlying said forward surface, said member being arcuate in cross-section and having a pair of end edges, a pair of longitudinal edges, and a convex surface in confronting relation to said container-receiving surface, said member having a lug projecting from a minor portion of each end edge thereof adjoining one of said longitudinal edges, each said lug being constituted by a coplanar continuation of said member of minor extent and having a convex surface is coplanar relation with said convex surface of said member and in confronting relation with said forward surface, said lugs being receivable in said channels for guiding movement therealong, said lugs having limited movement in a direction perpendicular to said channel walls to permit limited rocking movement about the axis of said arcuate surfaces with relation to said forward plate surface, said lugs having a position in said channels wherein said lugs are in engagement with said channel walls and a portion of said convex surfaces are in pressure applying relation to said forward plate surface, said member in said position having its major portion including the other longitudinal edge thereof lying forwardly of said forward surface and said channels and constituting the handle portion, each said channel having a portion projecting beyond one end edge of said plate, and a cap removably mounted on said channel end portions, said cap having a position in seated engagement with the end edges of said channel end portions and an edge in opposed spaced parallel relation to said plate end edge to form therewith a container-receiving slot.

U.S. Pat. No. 4,010,873

Inventor: Hovhannes H. Mardirossian

Issued: Mar. 8, 1977

A resilient frame for accommodating a tube of amorphous material has a cover part in operative proximity with a tube of amorphous material accommodated therein. A tube compressing device in the frame is guided by the frame for compressing the tube from the end thereof to the area of the neck thereof. The tube compressing device moves the cover part in a manner whereby the cover part covers the opening of the neck of the tube when the tube compressing device is a maximum distance from the neck of the tube and the cover part frees the opening of the neck of the tube for the transfer of amorphous material when the tube compressing device is moved toward the neck of the tube.

U.S. Pat. No. 4,125,206

Inventor: Bobby R. Wilson

Issued: Nov. 14, 1978

A device for containing and dispensing a selected amount of the contents within a tube. A box mounted to a plaque within the box is the transverse drive means that drives a carriage vertically. The carriage consists of a roller with horizontally adjusting means.

U.S. Pat. No. 4,850,971

Inventor: David P. Colvin

Issued: Jul. 25, 1989

This invention is an infusion pump utilizing a linear roller driven by a one or more constant force springs in combination with changeable flow regulating needles to provide a constant flow, gravity independent device. The spring constant is chosen so that infusion substantially decreases should the infusion needle become dislodged from the vein and come to rest in the surrounding tissue. Also, there is a means for introduction of an anticoagulant to maintain vein access if a delay is encountered in replacement of the infusion bag.

U.S. Pat. No. 5,035,347

Inventor: Federico Trovo

Issued: Jul. 30, 1991

The present invention consists of an improvement device for the squeezing of tubes containing paste, in particular toothpaste. The device in question consists of a tubular casing which can be affixed to the wall, inside which slides a piston fitted with a suitably shaped slit, into which the closed end of the tube containing the paste is inserted. The open end of the tube rests on the base of the said casing and the paste flows out through a hole present on the same base. The piston is pushed forwards by a threaded rod topped by a knob. As the piston slides, the sides of the slit produce, thanks to their particular shape, pressure on the tube which forces out the paste.

U.S. Pat. No. 5,810,205

Inventor: Nurl Kohen

Issued: Sep. 22, 1998

A dispenser for a collapsible tube, such as a tube of toothpaste, is disclosed. The dispenser comprises a dispenser body which has a base, a pair of opposing sides and a stopper. The stopper extends across one end of the base and has an opening in it which is large enough that the neck of the tube can extend through it, but not large enough for the rest of the tube to pass through. A reversible push block is designed to engage the opposing sides of the dispenser body and to slide along the length of the base to come into contact with the tube and force out its contents. One edge of the push block is thinner than the other. The thinner edge is used when the tube still has much of its original contents. The thicker edge is used by reversing the push block and is used when the tube is nearly empty to force out the last bit of useable product.

U.S. Pat. No. 6,401,978

Inventor: Christopher S. Young

Issued: Jun. 11, 2002

An apparatus for dispensing a substance from a collapsible tube. The apparatus comprises: a housing with a slider positioned therein, first and second flexible members passable through a passage in the slider, a rod for supporting the slider within the housing, and a motor coupled to the rod for causing rotation of the rod. When the rod rotates, the slider moves along the rod and urges the first flexible member toward the second flexible member. This movement causes the substance in the tube to be dispensed.

U.K. Patent Number GB2002321

Inventor: Peter David John Wright

Issued: Feb. 21, 1979

A device for squeezing contents from a deformable tube having one end closed and an outlet at the other end, comprising a resiliently deformable member, means for positioning the tube such that said deformable member can lie adjacent said one end thereof, and means for biassing the deformable member towards the other end of the tube when the tube is so positioned, whereby the deformable member may be pressed against the tube to deform it and squeeze a portion of the contents from the outlet, and the deformable member will thereafter be maintained adjacent the tube under the influence of the biassing means ready for a further squeezing operation. In a modification, the tube may be squeezed between two resiliently deformable rollers. In another embodiment, the deformable member is in the form of a self-coiling spring strip.

U.S. Pat. No. GB 2052434

Inventor: Rodney William Park

Issued: Jan. 28, 1981

A device for squeezing tubes, such as toothpaste tubes having two parallel rollers, between which the tube is inserted. One of the rollers is rotated so that the rollers, which are mounted in a slide, move along the length of the tube towards its neck. When sufficient of the tube contents has been dispensed, the rotation is stopped. An arrangement is provided to ensure that the rollers do not move back along the length of the tube after each dispensing step. As shown, the rotated one of the roller is provided with a flattened portion and is provided with a spring biasing the roller flattened portion into a position facing the other roller. Depression of a handle rotates the roller to bring its cylindrical surface to bear against the tube to hereby quantity of the tube contents are dispensed and the rollers progress down the tube. On release of the handle, the spring rotates the roller in the opposite direction so that its flat portion again faces the other roller whereby the rollers plus their slide move downwardly under gravity within a housing. In a modification, the roller is cylindrical and ratchet means are provided to permit the roller to be rotated in one direction only.

European Patent Application Number EP0078871

Inventor: David Knight

Issued: May 18, 1983

A dispenser for use in dispensing a viscous substance such as toothpaste from a manually-Compressible tube with an outlet nozzle comprises a support which holds the tube in a vertical position. A frame can slide vertically inside the support and carries two parallel rollers and which engage opposite sides of the tube. One of the rollers carries a lever which projects from the casing and can be pressed by the user to rotate the roller about its pivot axis. The pivot axis is eccentric so that movement of the lever in the direction A causes the roller to move towards the roller thus nipping the tube. Subsequent movement of the lever causes the second roller also to rotate so that the area of contact between the rollers and tube moves along the tube towards the nozzle squeezing material from the tube.

While these dispensers may be suitable for the purposes for which they were designed, they would not be as suitable for the purposes of the present invention, as hereinafter described.

SUMMARY OF THE PRESENT INVENTION

The present invention discloses a toothpaste dispenser comprising a housing with a movable lever in communication with a dispensing means engaging a tube of toothpaste within the housing. The housing is comprised of a cover and base with the base having side walls and an end wall with an aperture for inserting the tube spout. Mounted within the base is a pliable planar member that covers the collapsible tube when inserted therein. There is also at least one aperture within the base providing means for mounting the dispenser to a structure, such as a wall. The cover has opposing side walls and end wall for receiving the base and a longitudinal slot for the handle of the dispensing means to travel therealong. The dispensing means is comprised of a roller rotatable within a frame or bracket having an exteriorly positioned handle attached thereto. Once a collapsible tube is inserted under the pliable member and the spout cover is removed, the tube contents can be extruded by moving the handle that causes the roller to engage the pliable member thereby compressing the tube. The dispensing means engages the tube at its closed end and compresses the tube flat as it moves towards the nozzle or spout over time.

A primary object of the present invention is to provide storage for a collapsible tube that serves as a dispenser, which can be wall mounted.

Another object of the present invention is to provide a dispenser that can be manufactured in various colors and patterns to match the room decor.

Yet another object of the present invention is to provide a dispenser that will keep the tube against the base whether the roller is engaging the tube or not.

Still yet another object of the present invention is to provide a dispenser having a base and a removable cover whereby tubes can be easily inserted.

Another object of the present invention is to provide a dispenser wherein the base has an end wall with an aperture therethrough for placing a tube nozzle therein.

Yet another object of the present invention is to provide a base having a pliable member for keeping the tube in a fixed position.

Still yet another object of the present invention is to provide a cover for said dispenser having a longitudinal slot for moving the dispensing means therealong.

Another object of the present invention is to provide a dispenser having a dispensing means comprising an exteriorly positioned handle and an interiorly positioned roller.

Additional objects of the present invention will appear as the description proceeds.

The present invention overcomes the shortcomings of the prior art by providing a toothpaste dispenser comprising a housing with a movable lever in communication with a dispensing means engaging a tube of toothpaste within said housing. The housing is comprised of a cover and base with the base having side walls and an end wall with an aperture for inserting the tube spout. Mounted within the base is a pliable planar member that covers the collapsible tube when inserted therein. There is also at least one aperture within the base providing means for mounting said dispenser to a structure, such as a wall. The cover has opposing side walls and end wall for receiving the base and a longitudinal slot for the handle of the dispensing means to travel therealong. The dispensing means is comprised of a roller rotatable within a frame having an exteriorly positioned handle attached thereto. Once a collapsible tube is inserted under the pliable member and the spout cover is removed, the tube contents can be extruded by moving the handle that causes the roller to engage the pliable member and thereby compressing the tube. The dispensing means engages the tube at its closed end and compresses the tube flat as it moves towards the nozzle over time.

The pliable member covering the tube serves a dual purpose in that it displaces the forces applied by the roller over a larger area than would be possible if the roller where to engage the tube directly. In addition, the roller engaging the tube directly could cause the tube to curl as the contents are dispelled with the tube getting caught-up in the roller mechanism.

Furthermore, when the dispenser is wall mounted the pliable member will keep the tube positioned properly against the base permitting the roller to compress the tube rather than crush it, which can be the case with a new tube or when the roller is backed off of the tube allowing it to flop around.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
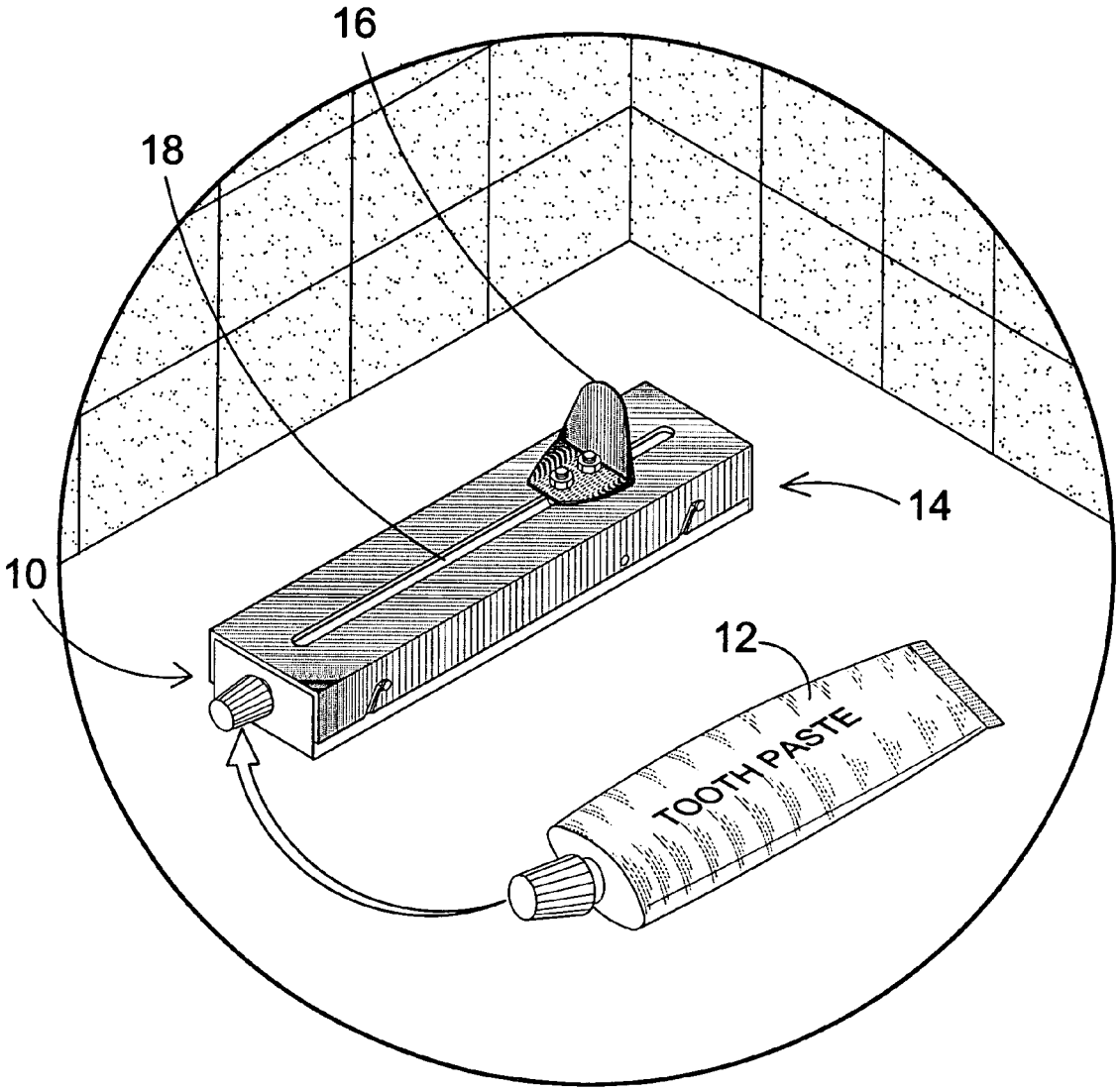
FIG. 1 is an illustrative view of the present invention.

With regard to reference numerals used, the following numbering is used throughout the drawings.

| | |
|---|---|
| 10 | present invention |
| 12 | tube |
| 14 | housing |
| 16 | handle |
| 18 | slot |
| 20 | base |
| 22 | cover |
| 23 | spout |
| 24 | pliable member |
| 26 | roller |
| 28 | aperture |
| 30 | nut |
| 32 | bolt |
| 34 | bracket |
| 36 | screw |
| 38 | aperture |
| 40 | pivot connection |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10. The present invention 10 discloses a dispenser for compressing collapsible tubes 12 such as tooth paste having a housing 14 with a pliable planar member engaging the tube and a slide member for applying a force to the planar member, the slide member comprising an exteriorly extending handle 16 in communication with an interiorly positioned roller, the housing having a base fastenable to a surface with a pivotal cover attached thereto with a slot 18 for moving the handle longitudinally along the cover dispensing the tube contents.

Figure 2:
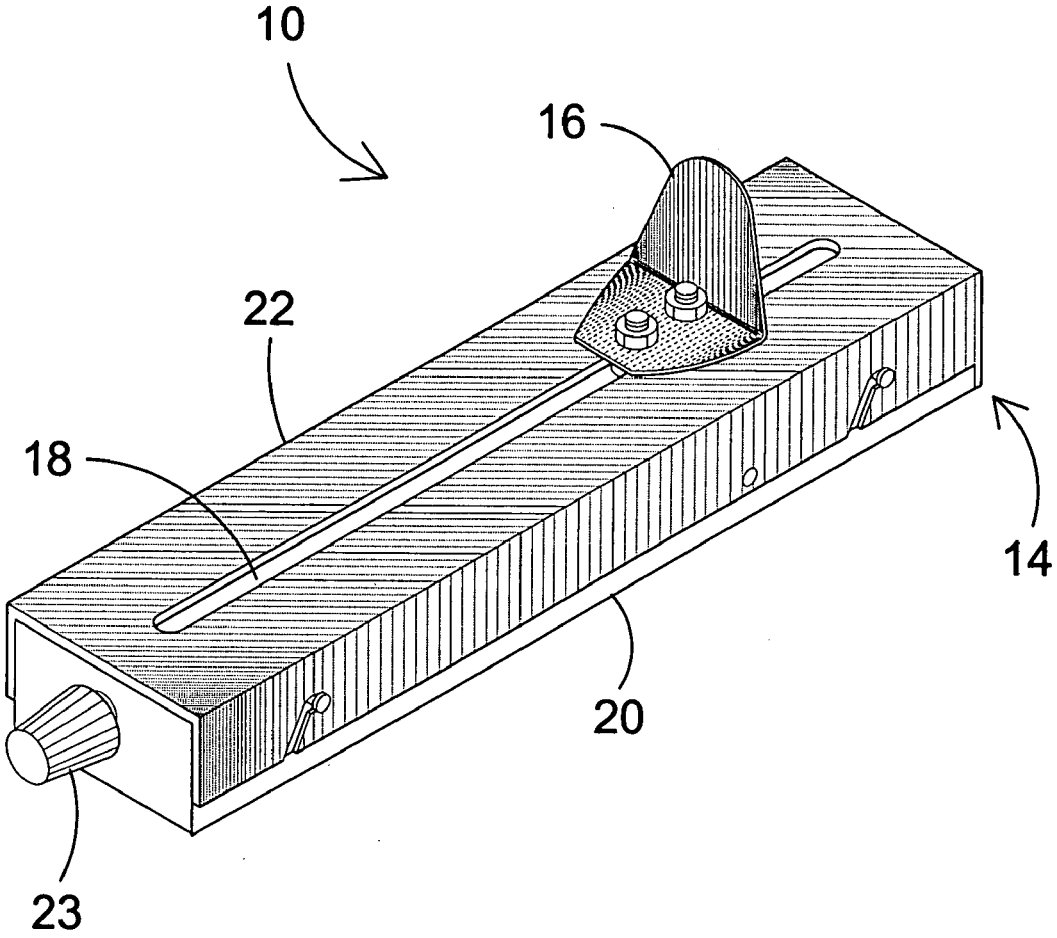
FIG. 2 is an assembled perspective view of the present invention.

Turning to FIG. 2, shown therein is an assembled perspective view of the present invention 10. Shown is the present invention 10 disclosing a dispenser for compressing collapsible tubes such as tooth paste having a housing 14 with a pliable planar member engaging the tube and a slide member for applying a force to the planar member, the slide member comprising an exteriorly extending handle 16 in communication with an interiorly positioned roller, the housing having a base 20 fastenable to a surface with a pivotal cover 22 attached thereto with a slot 18 for moving the handle longitudinally along said cover dispensing the tube contents. Also shown is the spout 23 of the tube.

Figure 3:
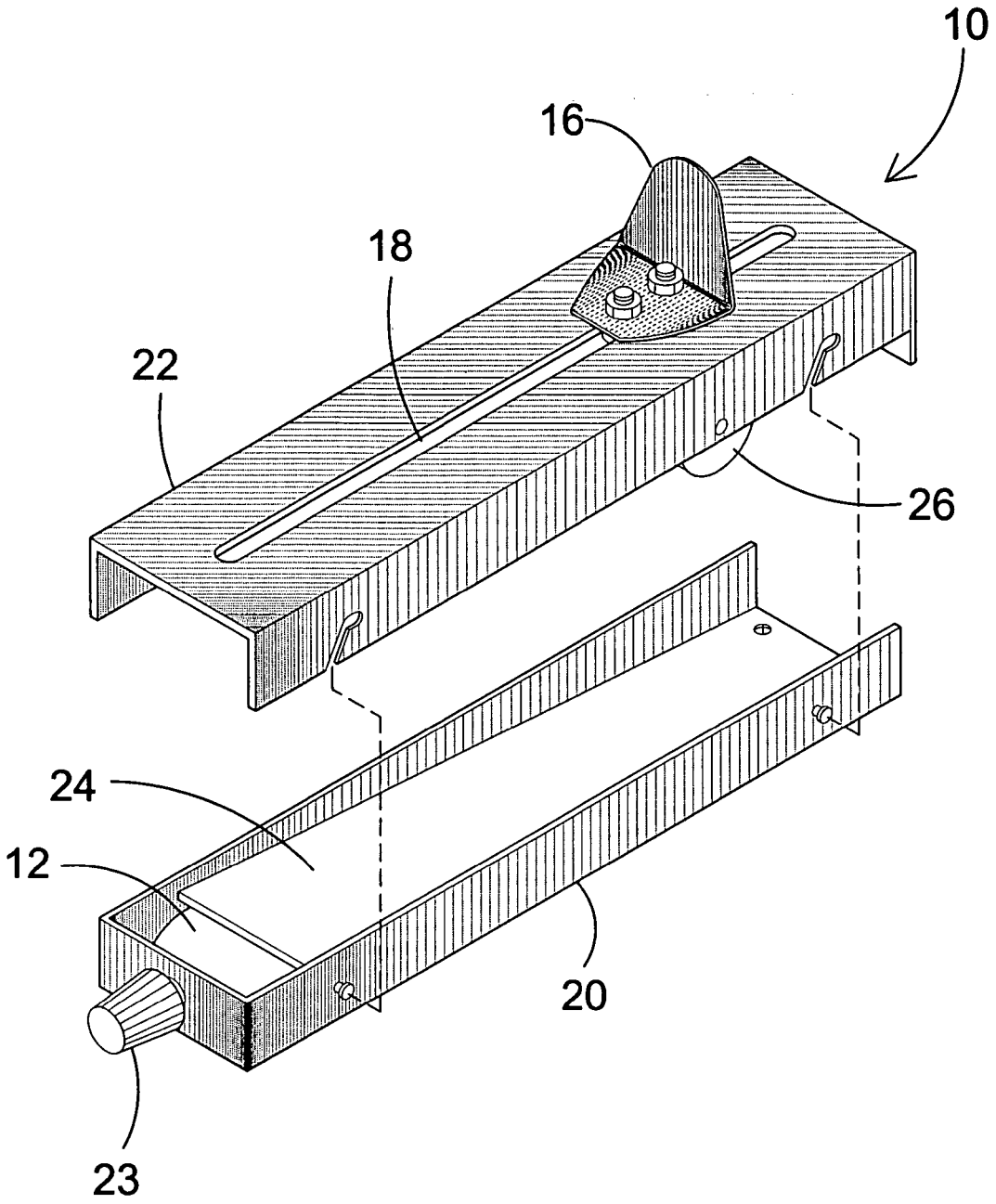
FIG. 3 is an exploded view of the present invention.

Turning to FIG. 3, shown therein is an exploded view of the present invention 10. Shown is the present invention 10 disclosing a dispenser for compressing collapsible tubes 12 such as tooth paste having a housing with a pliable planar compressor member 24 engaging the tube and a slide member for applying a force to the planar member, the slide member comprising an exteriorly extending handle 16 in communication with an interiorly positioned compressor roller 26, the housing having a base 20 fastenable to a surface with a pivotal cover 22 attached thereto with a slot 18 for moving the handle longitudinally along the cover dispensing the tube contents.

Figure 4:
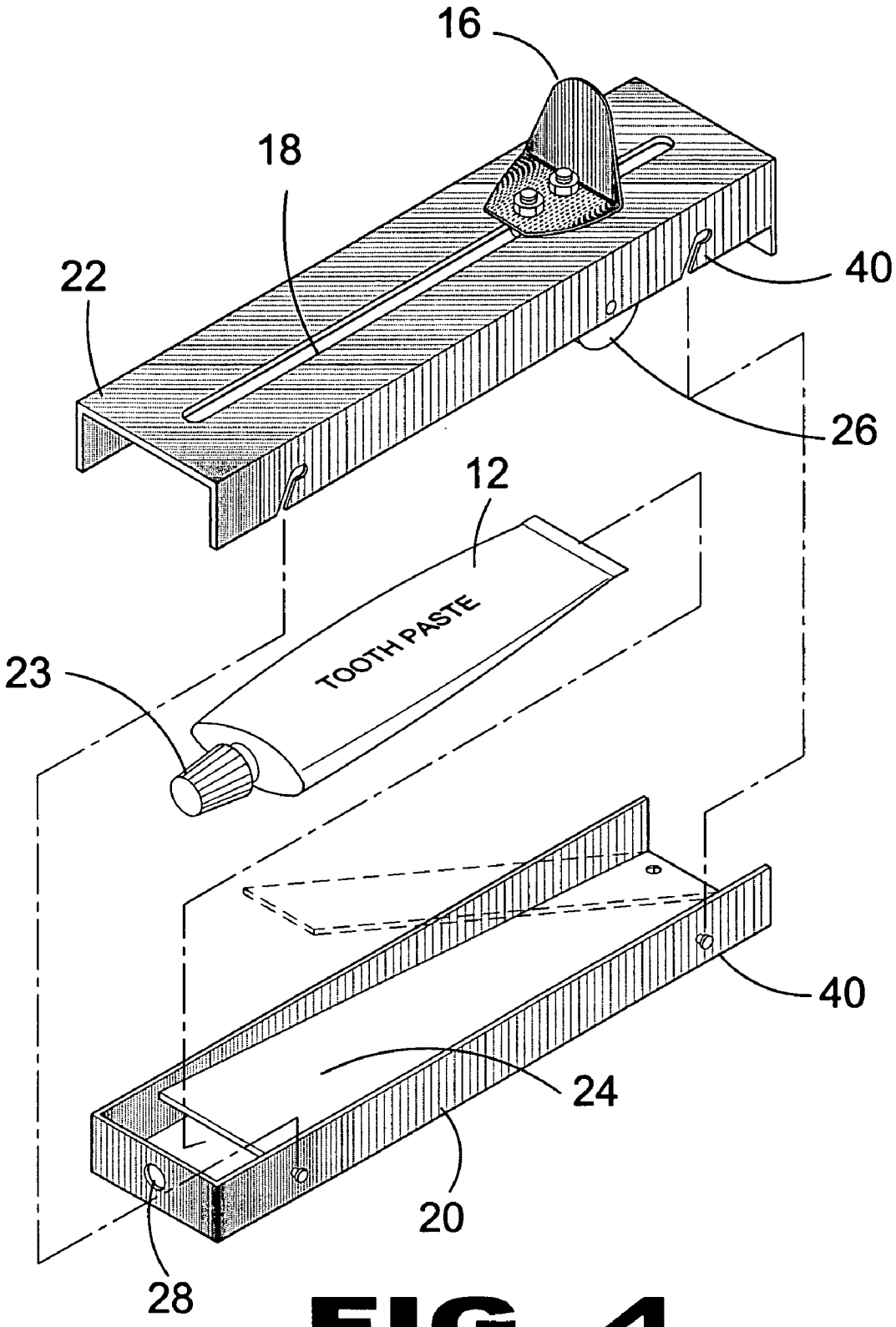
FIG. 4 is an exploded view of the present invention.

Turning to FIG. 4, shown therein is an exploded view of the present invention 10. Shown is the present invention 10 disclosing a dispenser for compressing collapsible tubes 12 such as tooth paste having a housing with a pliable planar member 24 engaging the tube and a slide member for applying a force to the planar member, the slide member comprising an exteriorly extending handle 16 in communication with an interiorly positioned roller 26, the housing having a base 20 fastenable to a surface with a pivotal at 40 cover 22 attached thereto with a slot 18 for moving the handle longitudinally along the cover dispensing the tube contents. Aperture 28 is shown for receiving the spout 23 of tube 12.

Figure 5:
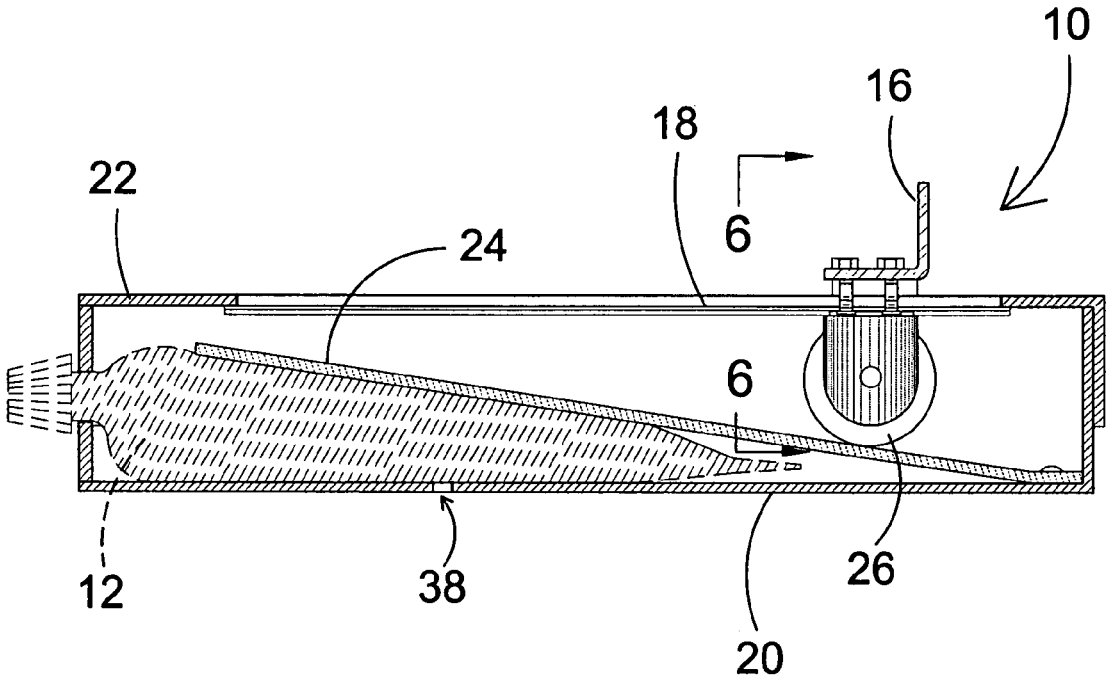
FIG. 5 is a sectional view of the present invention.

Turning to FIG. 5, shown therein is a sectional view of the present invention 10. Shown is the present invention 10 disclosing a dispenser for compressing collapsible tubes 12 such as tooth paste having a housing with a pliable planar member 24 engaging the tube and a slide member for applying a force to the planar member, the slide member comprising an exteriorly extending handle 16 in communication with an interiorly positioned roller 26, the housing having a base 20 fastenable to a surface with a pivotal cover 22 attached thereto with a slot 18 for moving the handle longitudinally along the cover dispensing the tube contents. Also shown is aperture 38 in the bottom of the base for receiving a fastener for mounting the base to a wall.

Figure 6:
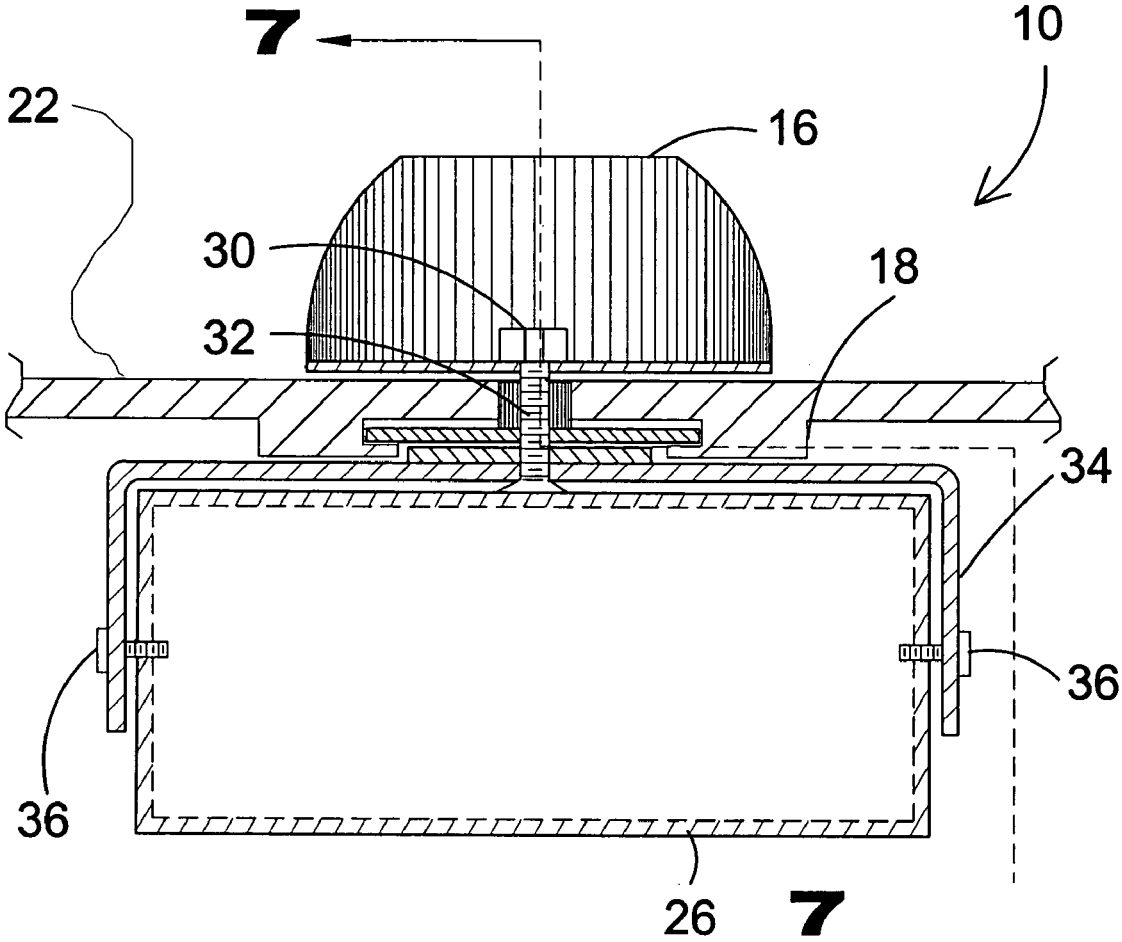
FIG. 6 is a cross sectional view of the present invention taken from FIG. 5.

Turning to FIG. 6, shown therein is a cross sectional view of the present invention taken from FIG. 5. Shown is the present invention 10 disclosing a dispenser for compressing collapsible tubes such as tooth paste having a housing with a pliable planar member engaging the tube and a slide member for applying a force to the planar member, the slide member comprising an exteriorly extending handle 16 in communication with an interiorly positioned roller 26, the housing having a base fastenable to a surface with a pivotal cover 22 attached thereto with a slot 18 for moving the handle longitudinally along the cover dispensing the tube contents. Also shown are handle 16 with nut 30 and bolt 32, roller bracket 34 with screws 36.

Figure 7:
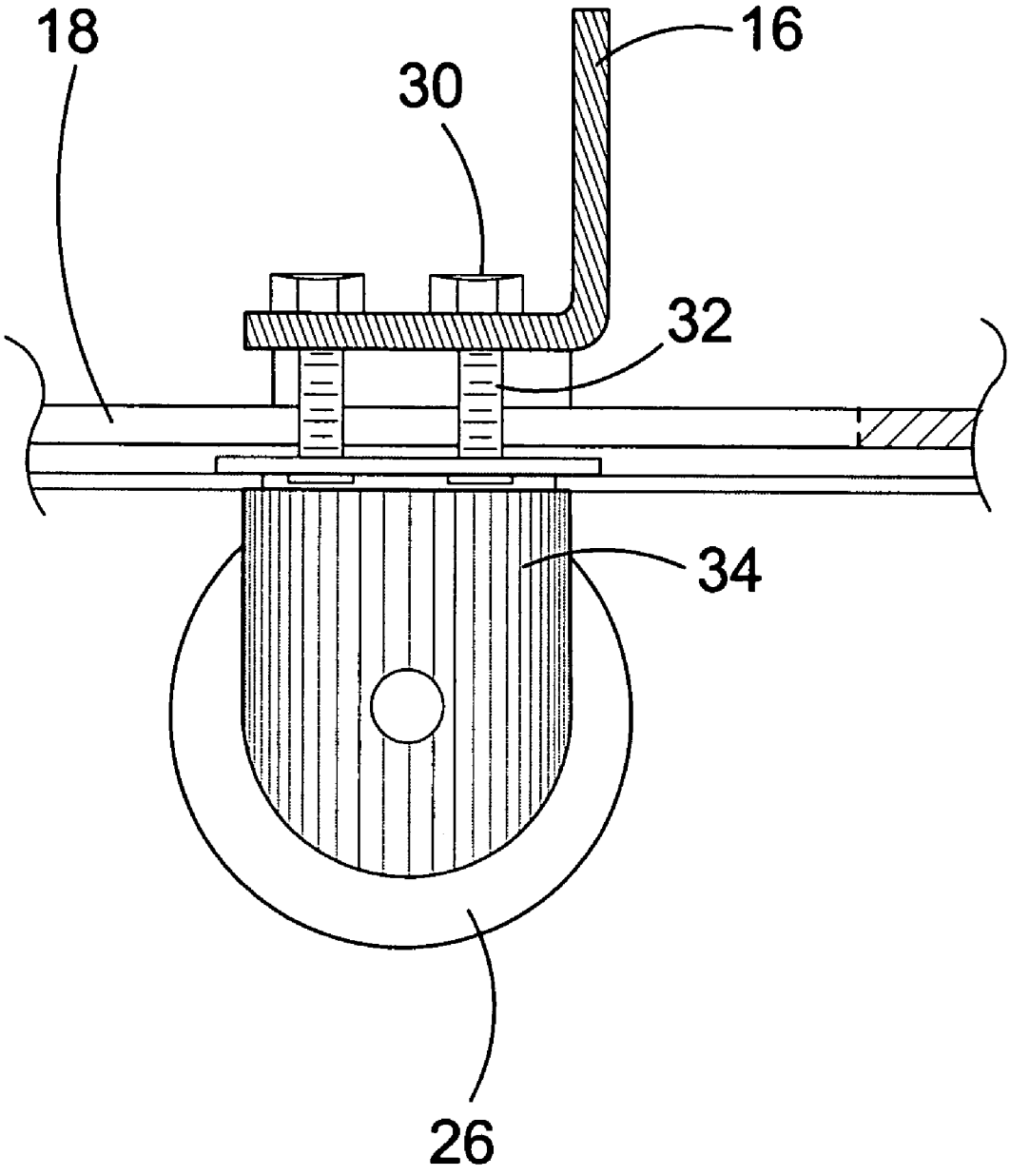
FIG. 7 is a cross sectional view of the present invention taken from FIG. 5.

Turning to FIG. 7, shown therein is a cross sectional view of the present invention taken from FIG. 5. Shown is the present invention 10 disclosing a dispenser for compressing collapsible tubes such as tooth paste having a housing with a pliable planar member engaging the tube and a slide member for applying a force to the planar member, the slide member comprising an exteriorly extending handle 16 in communication with an interiorly positioned roller 26, the housing having a base fastenable to a surface with a pivotal cover attached thereto with a slot 18 for moving the handle longitudinally along the cover dispensing the tube contents. Also shown are nut 30, bolt 32 and bracket 34.

Figure 8:
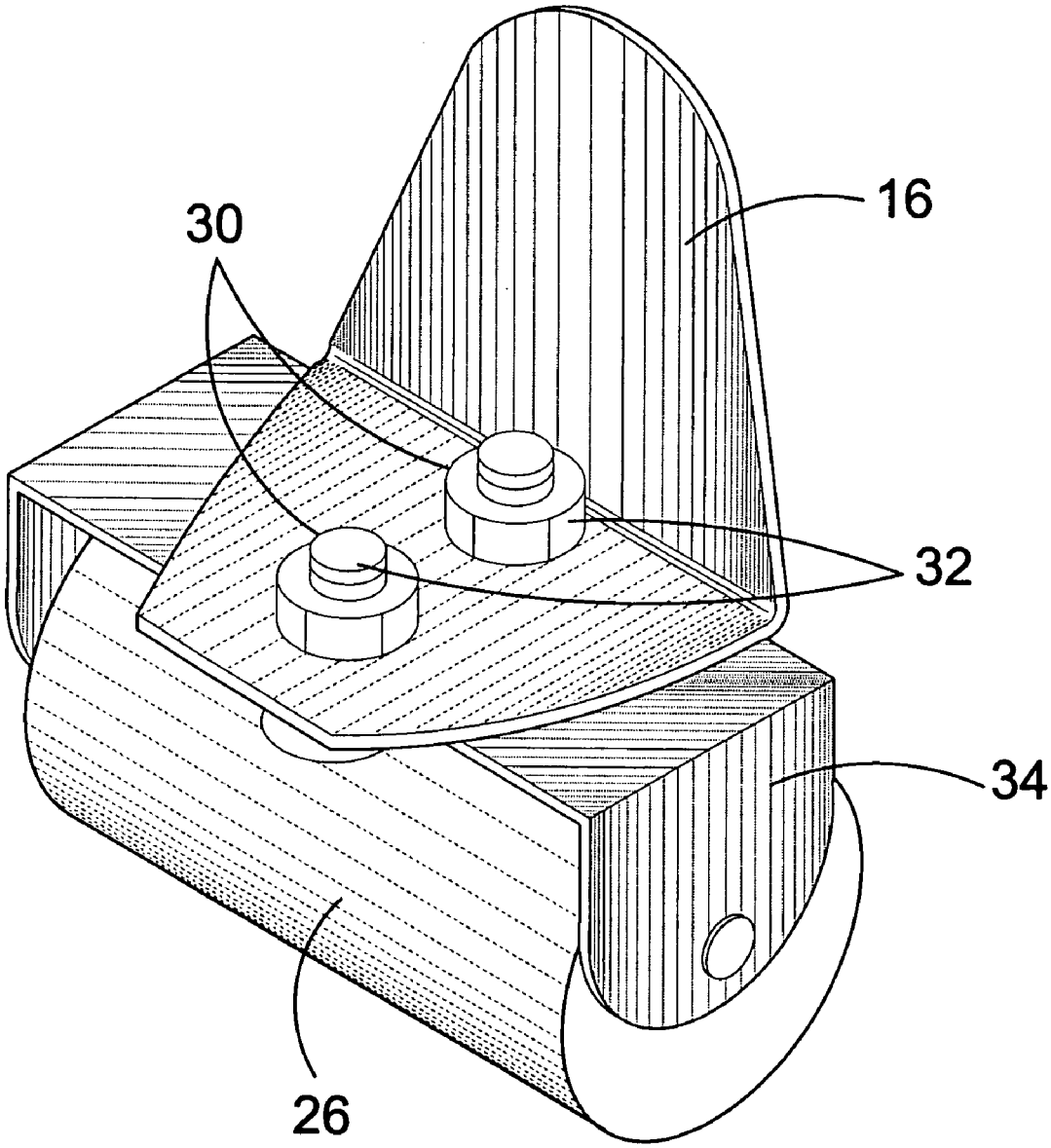
FIG. 8 is a detailed view of the sliding handle and compressing roller assembly of the present invention.

Turning to FIG. 8, shown therein is a detailed view of the sliding handle and compressing roller assembly of the present invention. Shown is the present invention disclosing a dispenser for compressing collapsible tubes such as tooth paste having a housing with a pliable planar member engaging the tube and a slide member for applying a force to the planar member, the slide member comprising an exteriorly extending handle 16 in communication with an interiorly positioned roller 26, the housing having a base fastenable to a surface with a pivotal cover attached thereto with a slot for moving the handle longitudinally along the cover dispensing the tube contents. Also shown are bracket 34, nut 30 and bolt 32.

Figure 9:
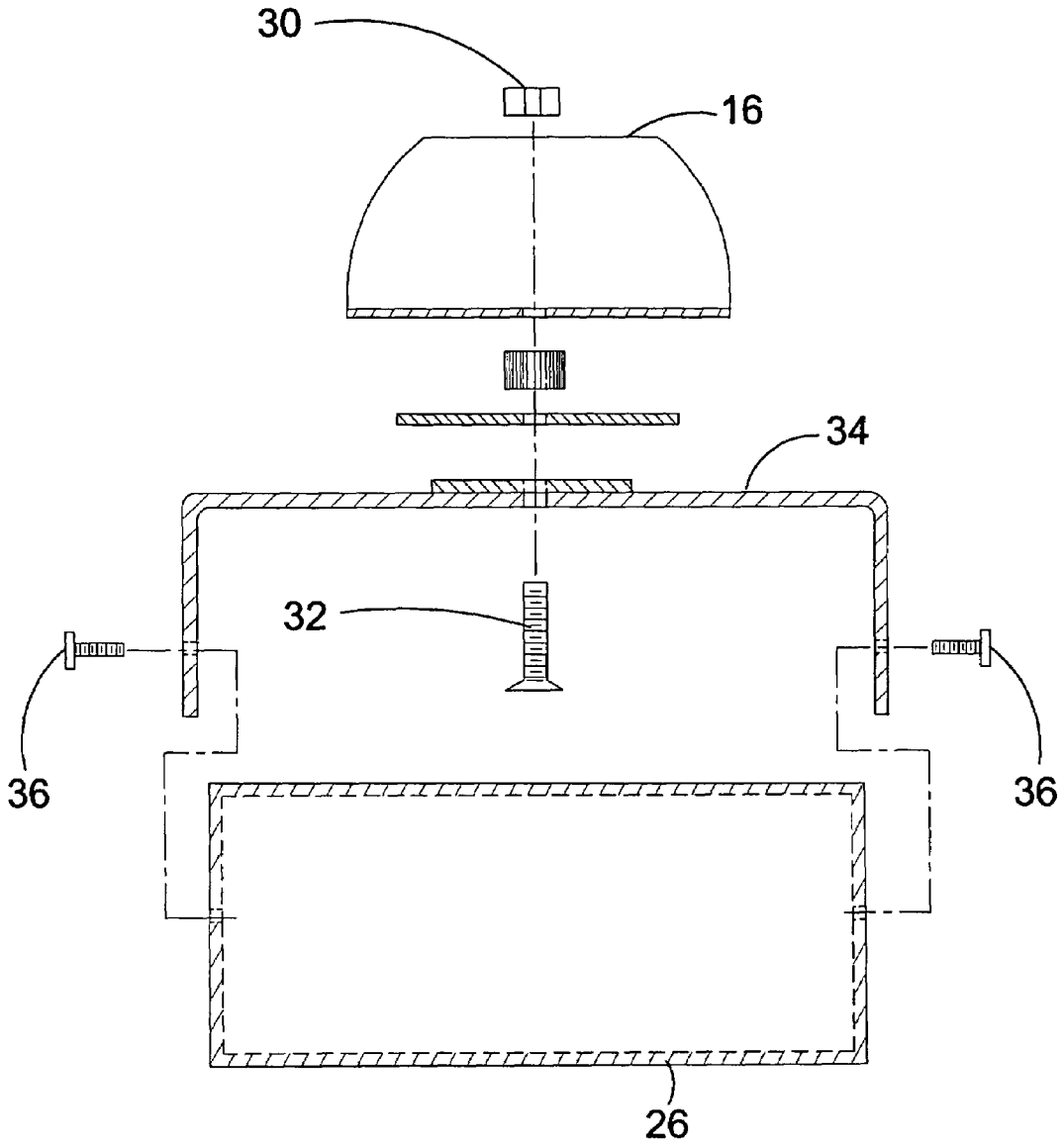
FIG. 9 is an exploded sectional view of the sliding handle and compressing roller assembly of the present invention.

Turning to FIG. 9, shown therein is an exploded sectional view of the sliding handle and compressing roller assembly of the present invention. Shown is the present invention 10 disclosing a dispenser for compressing collapsible tubes such as tooth paste having a housing with a pliable planar member engaging the tube and a slide member for applying a force to the planar member, the slide member comprising an exteriorly extending handle 16 in communication with an interiorly positioned roller 26, the housing having a base fastenable to a surface with a pivotal cover attached thereto with a slot for moving the handle longitudinally along the cover dispensing the tube contents. Also shown are bracket 34, nut 30 and bolt 32, and screws 36.

I claim:

1. An apparatus for providing a dispenser for collapsible tubes, the tube having a first closed end and a neck and spout on a second opposing end, comprising:

a) a housing having a base and a cover for said base, said base having a first end wall and a second end being open, a bottom, and first and second side walls, said first end wall having a first aperture therein, wherein the spout of the tube is inserted through said first aperture and the closed end of the tube is disposed toward said opening of said second end of said base, wherein said cover has a top surface, a second end wall for mounting over said opening of said second end of said base, a first and second side wall, being open on said first end, said top surface having a centrally disposed slot therein, said slot being longitudinally disposed in said top surface;

b) a pliable planar member being disposed in said base, said planar member having first and second ends and a top and bottom surface, said second end of said planar member being adapted for connection to said bottom of said second end of said base, said planar member extending from said second end of said base to an area adjacent the neck of the tube;

c) wherein the tube is disposed between said pliable planar member and said bottom of said base with the closed end of the tube being disposed adjacent said second end of said base and the spout of the tube being disposed through said first aperture of said first end wall of said base; and, d) means for a roller being disposed under said top surface of said cover whereby a user can push the roller from the second end of the cover toward the neck of the tube and the roller will push downwardly on the pliable planar member to force the contents out of the tube as the roller moves from the second end of the cover toward the neck of the tube.

2. The apparatus of claim 1, wherein said means for a roller comprises:

a) a cylindrical roller having first and second axial ends;

b) a U-shaped bracket for rotatably holding said roller, said bracket being downwardly disposed having first and second sides and a top disposed at its base, wherein said first and second sides of said bracket rotatably engage said first and second axial ends, respectively, of said roller so that said roller rotates in said bracket; and, c) a handle having top and bottom surfaces being connected to said top of said bracket, wherein said top surface of said handle is disposed on top of said cover to permit a user to push on the top of the handle and thereby move the roller along said base of said housing.

3. The apparatus of claim 2, further comprising at least one fastener for connecting said handle to said top of said bracket, wherein said fastener extends through said slot in said cover, wherein said top surface of said handle is disposed on top of said cover.

4. The apparatus of claim 3, wherein said fasteners comprise a threaded fastener.

5. The apparatus of claim 4, wherein said fasteners comprise a nut and bolt.

6. The apparatus of claim 5, wherein said housing is rectangular shaped.

7. The apparatus of claim 6, wherein said housing can be mounted onto a wall.

8. The apparatus of claim 7, wherein said bottom of said housing has a second aperture therein, wherein said housing can be mounted onto a wall by placing a fastener through said second aperture and attaching the housing to the wall.

9. The apparatus of claim 8, wherein said planar member is complementarily sized as said base of said housing.

10. The apparatus of claim 9, wherein said roller member is complementarily sized as said base of said housing.

11. The apparatus of claim 10, wherein said cover is pivotally connected to said base.

* * * * *